United States Patent [19]

Takahashi et al.

[11] Patent Number: 5,044,307

[45] Date of Patent: Sep. 3, 1991

[54] COATING WIDTH CHANGING DEVICE FOR USE IN CURTAIN COATING

[75] Inventors: Kunio Takahashi; Osamu Yamane; Yasunori Hori; Takanori Endo, all of Shizuoka, Japan

[73] Assignee: Fuji Photo Film Co., Ltd., Kanagawa, Japan

[21] Appl. No.: 538,445

[22] Filed: Jun. 15, 1990

[30] Foreign Application Priority Data

Jun. 19, 1989 [JP] Japan ..... 1-154534

[51] Int. Cl.[5] ..... B05C 3/18; B05C 5/00

[52] U.S. Cl. ..... 118/325; 118/DIG. 4

[58] Field of Search ..... 118/DIG. 4, 504, 261, 118/325, 419, 428; 427/420

[56] References Cited

U.S. PATENT DOCUMENTS 3,867,901 2/1975 Grieller ..... 118/325
4,479,987 10/1984 Koepke et al. ..... 118/DIG. 4
4,830,887 5/1989 Reiter ..... 118/DIG. 4
4,933,215 6/1990 Naruse et al. ..... 427/420

*Primary Examiner*—Willard E. Hoag
*Attorney, Agent, or Firm*—Sughrue, Mion, Zinn, Macpeak & Seas

[57] ABSTRACT

A curtain coating width changing device in which the width of the backup device at a coating portion can be rapidly changed continuously and smoothly. A backup roller supports a continuously running web. A pair of collar members is provided at respective opposite edge portions of the backup roller and is movable in the axial direction of the backup roller, the collar members lying on an extension of a top portion of the backup roller. A pair of spacers is provided in the spaces between the roller and corresponding ones of the collar members so as to form an extended surface of the top portion of the backup roller and to fill the spaces. Each of the collar members has a spiral end surface, whereby the effective axial length of the extended portion of the top portion of the roller can be adjusted by rotation of the spacers.

8 Claims, 2 Drawing Sheets

COATING WIDTH CHANGING DEVICE FOR USE IN CURTAIN COATING

BACKGROUND OF THE INVENTION

The present invention relates to a coating apparatus, and particularly to an apparatus for applying various types of coating compositions onto a continuously running elongated belt-like support (hereinafter referred to as a "web") used in manufacturing recording materials such as information recording paper, printing paper such as pressure-sensitive paper, heat-sensitive paper, diazo copying paper, and the like; photographic film, photographic light-sensitive materials such as photographic film, photographic paper, and the like; photosensitive printing plates; and magnetic recording materials such as magnetic recording tape and the like. More specifically, the present invention relates to a coating width setting device for a backup device for use when coating is carried out by causing a thin-film-like coating composition to strike against a running web.

A curtain coating apparatus has been known for performing coating by causing a thin-film-like coating composition to strike against a running web. A curtain coating apparatus is arranged such that a free falling curtain film of coating compositions of one or more types strikes against a material to be coated so as to produce a coating film on the material. Curtain coating apparatuses have been used conventionally for applications such as coating furniture and metal plates, but have more recently been applied to high-accuracy, high-speed coating as manufacturing techniques have improved.

As disclosed in U.S. Pat. Nos. 3,632,374, 3508,947, and 4,230,743 and Japanese Patent Unexamined Publications Nos. Sho. 52-74761, and Sho. 52-74762, the curtain coating method has been applied to applications in which high accuracy is required, such as in manufacturing photographic light-sensitive materials, pressure-sensitive copying recording paper, heat-sensitive recording paper, etc., with satisfactory results.

Such a coating apparatus, as shown in FIG. 4, is disclosed in commonly assigned Japanese Utility Model Unexamined Publication No. Sho. 59-176676.

As illustrated in that figure, a thin-film-like flowing layer 5 of a coating composition of at least one type flows along a downwardly slanting slide slope surface 4 and is made to strike against a running web 11 so as to perform coating on the running web 11. A support guiding mechanism, constituted by a rail 12, slide bodies 13, and a driving mechanism 14, is provided with which edge guides 8*a* and 8*b* supporting opposite ends of a free falling thin-film-like coating-composition film 6 are moved while maintaining a predetermined gap between a top end lip 7 of the slide slope surface 4 and the edge guides 8*a* and 8*b*.

Further, a method of changing a coating width so as to conform with the width of the web being coated is disclosed in commonly assigned Japanese Patent Unexamined Publications Nos. Sho. 60-75354, Sho. 61-477, and Sho. 61-35880.

In such conventional apparatuses, it is required that the entire width of the flowing layer 5 flowing down along the slide slope surface 4 from a slot 3 of a coating composition feeder 1 be made larger than that of the support 11. The free falling curtain film 6 is applied to form a coating with the distance between the edge guides 8*a* and 8*b* being set to conform with the width of the support. Surplus coating composition not striking the support is collected.

In the curtain coating method, the free falling curtain film is held at its opposite edges by the two edge guides 8*a* and 8*b*. However, if the entire curtain is applied to the support by the use of the edge guides, formation of considerably thicker coating portions occurs at the edge portions of the web than in other portions thereof.

Accordingly, various problems occur in practical use. That is, when the entire curtain is applied on the support, the thicker coating portions produced at the opposite edge portions of the coating layer require a longer drying time than portions of normal thickness. Consequently, if the drying process has insufficient capacity to dry the thicker coating portions, the thicker coating portions are left in a tacky state, causing problems such as the undried coating composition being transferred to the conveying rollers disposed after the drying stage to thereby foul the web in following stages, or the opposite edge portions being bonded when winding the support around a roll in a take-up step, sometimes causing the support may to break when it is unwound in a subsequent cutting step.

To eliminate the problems caused by the formation of thicker coating portions at the opposite edge portions of the coating layer and by the curtain coating having a width greater than that of the support in the conventional curtain coating, commonly assigned Japanese Patent Unexamined Publication No. Sho. 58-3672 discloses a coating method for forming a free falling curtain of a coating composition and coating a running web in which the opposite edge portions of the support are folded toward an uncoated surface side before the support is coated.

However, to coat webs of various different widths, it is necessary to make the width of a backup device (such as a backup roller, collars attached to the backup roller at its opposite end portions, etc.) coincident with the web to be coated. Accordingly, even if collars are attached to the backup roller for the purpose of width adjustment, the width cannot be changed continuously and smoothly, but must be changed in discrete steps. As a result, much time and labor are required to change the coating width.

SUMMARY OF THE INVENTION

It is therefore an object of the present invention to provide a curtain coating device in which the problems described above are solved and in which the width of a backup device can be continuously and smoothly changed.

In order to attain the above and other objects of the invention, in a coating apparatus for performing coating by forming a free falling curtain film striking a continuously running elongated belt-like web, there is provided a curtain coating width changing device which comprises: at least one collar member provided at an edge portion of a backup roller and movable in the axial direction of the backup roller, the collar member lying on an extension of the top portion of the backup roller; and at least one spacer which is provided in a space between the backup roller and the collar member so as to form an extended surface of the top portion of the backup roller to thereby fill the space, wherein the spacer is provided with a spiral end surface so that the axial length of the extended portion of the top portion of the roller can be adjusted by forward/reverse rotation of the spacer.

The coating width changing device of the present invention is provided at one edge portion of the back roller when the coating width is to be changed at one edge of the roller while the opposite edge is fixed. If, however, it is desired to change the coating width at both edges, the coating width changing devices are provided at respective opposite edge portions of the roller.

According to the present invention, the collar members provided at the respective opposite edge portions of the backup roller and which are movable in the axial direction of the backup roller on an extension of the top portion of the backup roller determine the width of the backup device according to the width of the web to be coated in cooperation with the spacers provided between the roller and the collar members so as to form extended surfaces of the top portion of the roller to thereby fill the respective spaces. Accordingly, when the web with its ends folded passes the backup device, it is necessary that the collar members have parallel end surfaces which are coincident with the folded lines at the edge portions of the web.

Further according to the present invention, the spacers have spiral end surfaces so that the length of the extended portions of the top portion of the roller can be adjusted by the forward/reverse rotation of the spacers. Thus, the extended surfaces of the top portion of the backup device can be changed continuously and smoothly by the spacers in cooperation with the collar members.

Although any material such as metals, plastics, etc., can be used for the collar members and the spacers in the present invention, it is necessary to select the material of the collar member and the spacer in a case where there is significant contact friction between the running web and the spacers because the collar members and the spacers do not rotate when the web is running.

Further, a device for controlling the opposite edges of the web (see Japanese Patent Unexamined Publication No. Sho. 58-3672) may be provided along the outer edges of the collar members at the outside of the extended surfaces formed by the spacers and the collar members.

As used herein, the term "coating composition" includes various types of liquid compositions, for example, various types of coating compositions for information recording paper such as pressure-sensitive paper, heat-sensitive paper, diazo copying paper, etc.; coating compositions for photosensitive emulsion layers, undercoating layers, protective layers, backing layers, etc., as in photosensitive materials; coating compositions for magnetic layers, undercoating layers, lubricating layers, protective layers, backing layers, etc., as in magnetic recording media; and coating compositions for adhesive agent layers, coloring layers corrosion preventing layers, and the like. These coating compositions generally contain a water-soluble binder or an organic binder.

The belt-like supports to be used with the present invention include paper, plastic film, metal, resin-coated paper, synthetic paper, etc. For the plastic film, materials can be used such as polyolefins such as polyethylene, polypropylene, and the like; vinyl polymers such as polyvinyl acetate, polyvinyl chloride, polystyrene, and the like; polyamides such as 6,6-nylon, 6-nylon and the like; polyesters such as polyethylene terephthalate, polyethylene-2-6-naphthalate and the like; polycarbonate; cellulose acetates such as cellulose triacetate, cellulose diacetate, and the like. Although polyolefins such as polyethylene or the like are representative of the resin to be used for the resin-coated paper, the resin is not always limited to polyolefins. Further, metal web, for example, an aluminum web, may be used.

DESCRIPTION OF THE PREFERRED EMBODIMENTS

Figure 1:
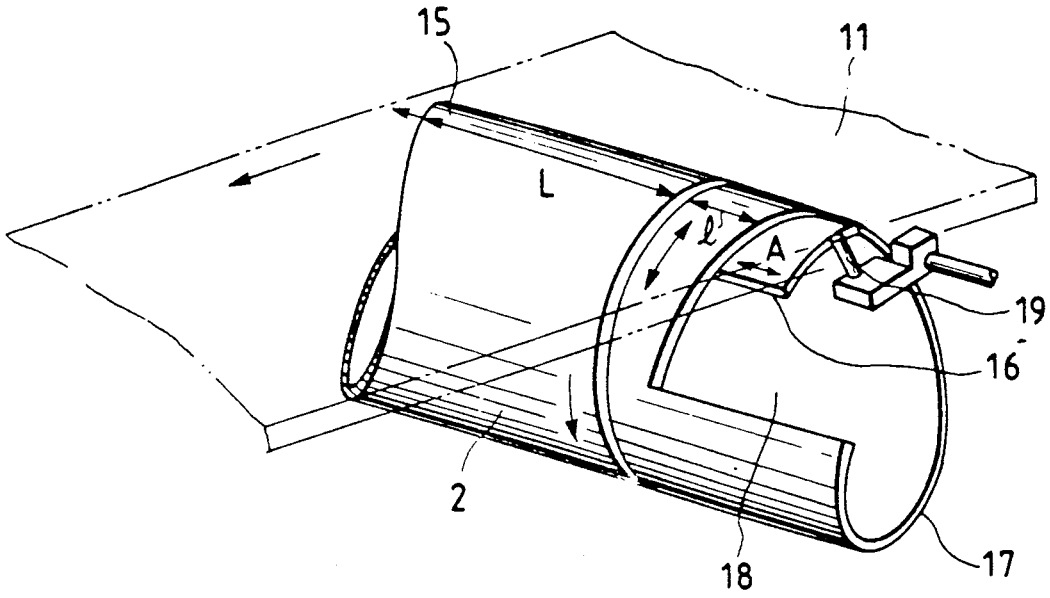
FIG. 1 is a partial schematic perspective view of a preferred embodiment of a curtain coating width changing device according to the present invention.

Referring to the drawings, preferred embodiments of the present invention will be described in detail.

In the curtain coating apparatus described above and shown in FIG. 4, a curtain coating width changing device according to the present invention is attached to opposite edge portions of a backup device for supporting a web 11 in the area where the coating operation is performed.

Figure 2:
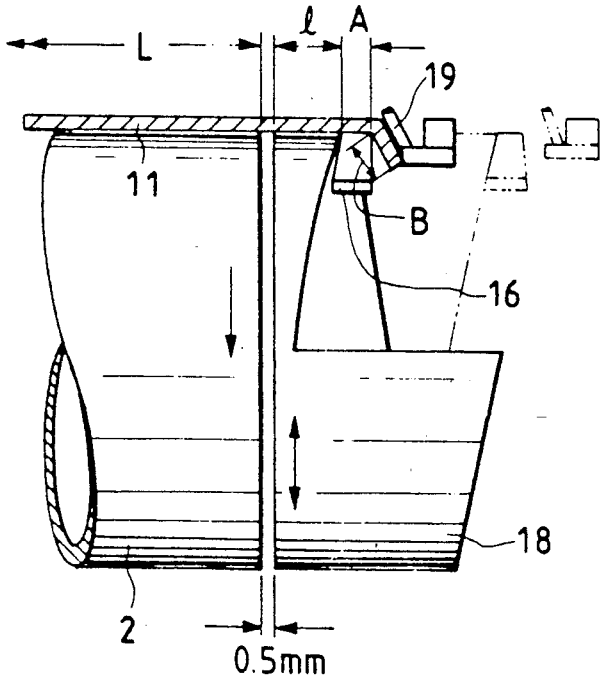
FIG. 2 is a partial side view of the device of FIG. 1.

FIG. 1 is a perspective view of a preferred embodiment of the invention showing a side portion of the coating width changing device according to the present invention, and FIG. 2 is a side view of FIG. 1. As shown in FIGS. 1 and 2, the coating width changing device for use in curtain coating is provided, at each side thereof, with a collar member 16 mounted so as to be movable in the axial direction of backup roller 2 along an extension line of a top portion 15 of the backup roller 2, the latter being in contact with a web 11, and a spacer 18 having a spiral end surface 17 and being provided in the space between the roller 2 and the collar member 16 so as to form an extended surface of the top portion 15 of the roller 2 and to fill the space so that the length of the extended portion of the top portion 15 of the roller 2 can be adjusted by the forward/reverse rotation of the spacer 18. Reference numeral 19 designates an edge folding device as disclosed in the above Japanese Patent Unexamined Publication No. Sho. 58-3672.

The relation between the web width and the backup roller width is expressed by the following equation:

$$w=L+2(l+A+B)$$

where, w: the width of the web

L: the length of the backup roller l: the width of the spacer

A: the width of the collar member

B: the width of the folded edge

A gap of about 0.5 mm is left between the backup roller 2 and the spacer 18 because the backup roller rotates and the spacer 18 does not rotate.

The width l of the spacer 18 is adjusted, by the forward/reverse rotation of the spacer, so that the relation $l=((w-L)/2)-(A+B)$ is satisfied with respect to the width w of the running web. For the adjustment (the collar member 16 is horizontally moved along the spiral end surface 17 of the spacer 18 while maintaining the extended surface of the top portion 15 of the backup roller 2.

In the case where the edge folding device is provided in the coating width changing device, the edge folding device 19 is arranged so as to move horizontally while maintaining a gap between the collar member 16 and the edge folding device 19. The power for forward-/reverse rotation of the spacer 18 and the power for the horizontal movement of the collar member 16 may be obtained through a link mechanism or by a separately provided mechanism.

The outer diameter of the spacer 18 is selected to be equal to or not larger than that of the backup roller 2.

The end surface of the collar member is designed so that folds of the web at the folded edges thereof are not damaged.

Although an edge folding device 19 is used in the above-described embodiment, it is not always necessary to provide such an edge folding device 19 in the device according to the present invention.

Figure 3:
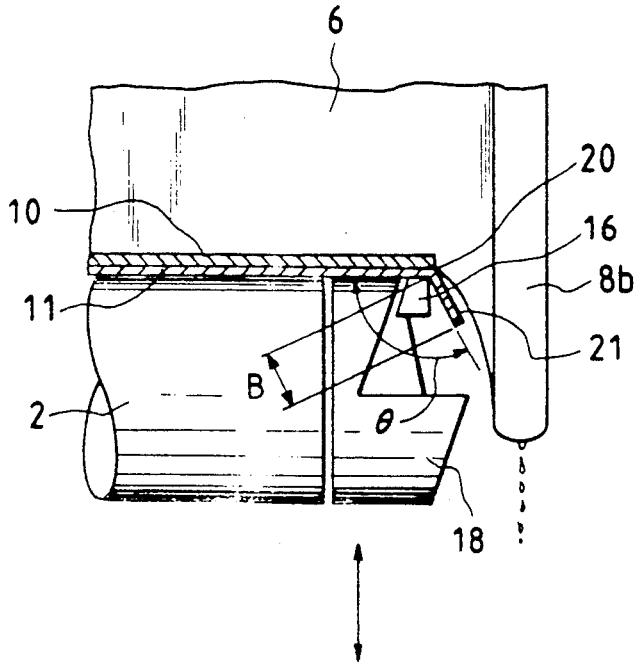
FIG. 3 is a partial front view for explaining the relation between the curtain film and the coating width changing device in a curtain coating apparatus constructed according to the present invention.

Referring to the drawings, the operation of the curtain coating width changing device according to the present invention will be described. FIG. 3 is a front view showing one side of the curtain coating width changing device according to the present invention.

As shown in FIG. 3, the edge portion of the web is folded toward the uncoated surface by the edge folding device, which presses the upper surface of the edge portion of the web. In practice, the edge folding device may be attached before or on top of the backup roller. The edge portion of the free falling curtain film 6 is supported by the edge guide **8*b*, and the free falling curtain film 6 of the coating composition, which is wider than the folded web, thereby forms a coating layer 10** on the web.

Figure 4:
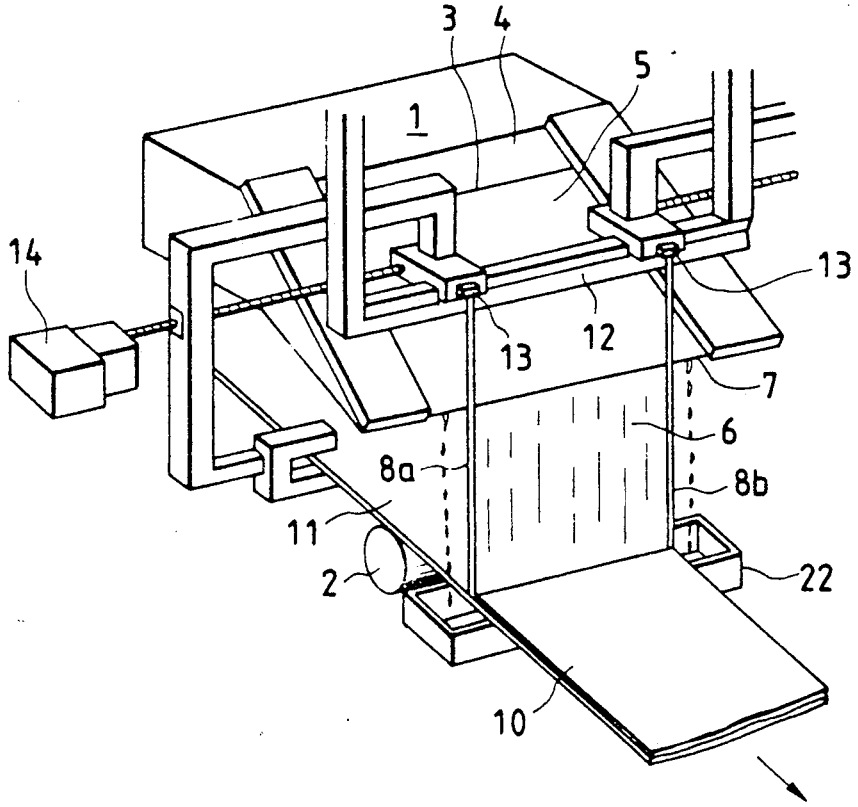
FIG. 4 is a perspective view of an example of a curtain coating apparatus.

The backup roller may be provided at a position where the web receives the free falling curtain film or at a position before the free falling curtain, as shown in FIG. 4.

Of the overall width of the curtain, the part of the curtain outside a corner portion 20 of the web and which is not applied to the web contracts in an arch so that the folded web edge portion 21 is not coated. Thus, portions of the web in the vicinity of the edge guide are not coated so that no uneven coating is formed at the edge portions of the coating layer. Specifically, in the case where paper is used as the web, because the folded web edge portions 21 are not coated, no curling toward the uncoated surface occurs. That is, the advantageous effects described above are obtained because of the coincidence between the width of the backup roller and the coated width of the folded web.

The surplus coating composition falling outside of the corner portion 20 of the web and which is not applied to the web is collected in a collecting vessel 22 for reuse.

After the web has passed through the coating zone, the folded and uncoated web edge portion 21 is unfolded to restore the original width of the web.

If desired, the fold can be maintained during passage through the coating zone by means of a fold keeper, similar to the backup roller.

Thus, portions of the web in the vicinity of the edge guide are not coated so that no uneven coating is formed at the edge portions of the coating layer 10. On the other hand, after the web has passed through the coating zone, the folded and uncoated web edge portion is unfolded to restore the original width of the web, and no curling toward the uncoated surface occurs.

The folding angle $\theta$ of the folded portion of the web edge portion in the coating zone is generally established so as not to be larger than 120 degrees, preferably not larger than 100 degrees. That is, the folding angle is set such that the edge portions of the coating composition are separated from the main part of the curtain at the respective corner portions 20 of the folded web so that the edge portions of the coating component are made to contact and flow down along the edge guides so as not to be applied onto the edge portions 21 of the folded web.

It is necessary that the folded corner portions of the web be restored following coating to such a degree that no defects occur in the manufactured product. Accordingly, the folding angle $\theta$ should be experimentally determined in accordance with factors such as the viscosity, surface tension and flow rate per unit width of the coating compositions, the radius of curvature of the corner portion 20 of the web in the case where the web is folded by an angle corresponding to the bending rigidity due to its thickness, the type of material of the web, and the coating properties of the web surface.

It is matter of course that the folded-portion width B of the web should be determined in accordance with the required size of the final product, and is selected so that a coating of uniform thickness can be formed at least within the width which is required for the final products. Generally, the width B is selected to be less than about 10 mm since such a fold can be easily formed.

In order to clarify the effects of the present invention, examples will be described hereunder. The present invention is not limited to these examples, however.

In the curtain coating apparatus as shown in FIG. 4, the coating width changing device according to the present invention and an edge folding device were attached to the backup roller 2, and webs having different coating widths were coated. The dimensions of the coating width changing device were as follows.

Maximum width of the spacer: $l_{max}=250$ mm
Minimum width of the spacer: $l_{min}=20$ mm
Width of the collar: A = 30 mm

EXAMPLE 1

Before a paper web running at a speed of 600 m per minute and having a weight of 40 g/m$^2$ was coated, the opposite edge portions of the paper were folded at a folding angle of 90 degrees with a folding width of 5 mm. Then, a free falling curtain formed of a coating composition for pressure-sensitive paper and having a composition as shown in the following Table 1, and which had a solid content concentration of 23 wt %, viscosity of 40 cps, and surface tension of 34 dyne/cm (at a temperature of 25° C.) was formed. The free falling curtain was applied to the paper web at a coating rate of 14 cc/m$^2$ (wet state).

TABLE 1

| | |
|---|---|
| Microcapsule for pressure-sensitive paper with melamine-formaldehyde resin as main wall material | 18 wt % |
| Surface-active agent (dodecyl benzen amine sodium sulfonate) | 3 cc/1000 cc |
| Binder-(PVA) and protecting agent (cmc) 5 cc/1000 cc | 5 wt % |

In the coating operation, the coated portion was observed. The part of the free falling curtain outside the corners formed by folding and which was not applied to the web contracted so that the folded portions of the web remained uncoated.

Further, the coated web was observed just after coating. The fold of the web was recovered at a position about 15–20 cm to the rear of the coating position so that the edges of the web were restored to be substantially even with the coated surface, and no creasing was observed at the opposite edge of the coated paper.

Next, the coated paper was dried in the normal manner and the dried paper was observed. In the coated paper, no creasing was observed, the coated layer was sufficiently uniform, and no thick coating at the opposite edge portions of the coated layer was seen. Further, the opposite edge portions when the web was subsequently wound up has no convex portions.

EXAMPLE 2

The same apparatus as in Example 1 was used, and the spacers were adjusted so as to make the width of the backup roller coincident with the width of the web to be coated. Before a paper support running at a speed of 300 m per minute and having a weight of 50 g/m$^2$ was coated, the edge portions of the paper support were folded at a folding angle of 100 degrees with a folding width of 3 mm. Then, a free falling curtain made of a coating composition for heat-sensitive paper and having a composition as shown in the following Table 2 and which had solid content concentrations of 41 wt %, viscosity of 96 cps, and surface tension of 36 dyne/cm (at a temperature of 25° C.) was formed, and was applied to the paper support at a coating rate of 30 cc/m$^2$ (wet state).

TABLE 2

| | |
|---|---|
| Color former (3,3-bis(p-dimethylaminophenyl)-6-dimethyl-aminophthalide | 100 g/1000 cc |
| Developer (2,2-bis-4-hydroxyphenol) propane | 110 g/1000 cc |
| Binder (starch) and filler (kaolin) | 200 g/1000 cc |
| Sulfosuccinic acid ester | 3 cc/1000 cc |

After the coating operation was completed, the inside of the conveying drying zone was observed. As a result of the observation, it was seen that the opposite edge portions of the web were not coated.

The dried coated paper was also observed. The coating layer was sufficiently uniform, and no thicker coating at the opposite edge portions of the coating layer was seen. Further, the opposite edge portions of the coating layer when subsequently wound up had no convex portion and could be wound to a length of 25,000 m.

In the curtain width changing device according to the present invention, the width of the backup device at a coating portion can be rapidly changed continuously and smoothly. As a result, the preparation time and labor for changing the coating width required with the conventional is unnecessary, and a desired width can be immediately obtained. Thus, productivity can be improved.

Further, when the device according to the present invention is used together with an edge folding device, the thicker coating formed at the opposite edge portions of the coating layer can be eliminated. Thus, the invention contributes to productivity as well as to the quality of the product.

What is claimed is:

1. In a coating apparatus for performing coating by forming a free falling curtain film striking a continuously running elongated belt-like web, a curtain coating width changing device comprising:

a backup roller for supporting said web;

at least one collar member provided at an edge portion of said backup roller and movable in the axial direction of said backup roller, said collar member lying on an extension of a top portion of said backup roller; and at least one spacer provided in a space between said roller and said collar member so as to form an extended surface of said top portion of said backup roller and to fill said space, said spacer having a spiral end surface whereby the effective axial length of said extended portion of said top portion of said roller can be adjusted by forward/reverse rotation of said spacer.

2. The coating apparatus of claim 1, further comprising edge folding means for folding edge portions of said web at outer edges of said collar member.

3. The coating apparatus of claim 2, wherein said collar member is set so that the relation $l=(w-L)/(2)-(A+B)$ is satisfied with respect to a desired width w of said web, wherein:

L: the length of said backup roller l: the width of said spacer

A: the width of said collar member

B: the width of folded edges of said web.

4. The coating apparatus of claim 2, wherein a gap is left between said backup roller and said spacer.

5. The coating apparatus of claim 2, wherein a width of said gap is about 0.5 mm.

6. The coating apparatus of claim 2, wherein a folding angle of said folded edges of said web is less than 120 degrees.

7. The coating apparatus of claim 2, wherein a folding angle of said folded edges of said web is less than 100 degrees.

8. The coating apparatus of claim 3, wherein B is about 10 mm.

* * * * *